US007710324B2

(12) United States Patent
Tatarnikov et al.

(10) Patent No.: US 7,710,324 B2
(45) Date of Patent: May 4, 2010

(54) PATCH ANTENNA WITH COMB SUBSTRATE

(75) Inventors: Dmitry V. Tatarnikov, Moscow (RU); Andrey V. Astakhov, Moscow (RU); Pavel P. Shamatulsky, Moscow (RU); Igor V. Soutiaguine, Moscow (RU); Anton P. Stepanenko, Moscow (RU)

(73) Assignee: Topcon GPS, LLC, Paramus, NJ (US)

( * ) Notice: Subject to any disclaimer, the term of this patent is extended or adjusted under 35 U.S.C. 154(b) by 384 days.

(21) Appl. No.: 11/280,424

(22) Filed: Nov. 16, 2005

(65) Prior Publication Data

US 2007/0205945 A1 Sep. 6, 2007

Related U.S. Application Data

(60) Provisional application No. 60/644,948, filed on Jan. 19, 2005.

(51) Int. Cl.
*H01Q 1/38* (2006.01)

(52) U.S. Cl. ..... 343/700 MS

(58) Field of Classification Search ..... 343/700 MS
See application file for complete search history.

(56) References Cited

U.S. PATENT DOCUMENTS

| | | | |
|---|---|---|---|
| 4,367,474 | A | 1/1983 | Schaubert et al. |
| 4,386,357 | A | 5/1983 | Patton |
| 4,827,266 | A | 5/1989 | Sato et al. |
| 4,924,236 | A | 5/1990 | Schuss et al. |
| 5,473,334 | A | 12/1995 | Vee et al. |
| 5,712,605 | A | 1/1998 | Flory et al. |
| 5,870,057 | A | 2/1999 | Evans et al. |
| 5,926,136 | A | 7/1999 | Ohtsuka et al. |
| 6,075,485 | A | 6/2000 | Lilly et al. |
| 6,121,931 | A | 9/2000 | Levi |
| 6,147,572 | A | 11/2000 | Kaminski et al. |

(Continued)

FOREIGN PATENT DOCUMENTS

GB 2147744 A * 5/1985

(Continued)

OTHER PUBLICATIONS

J.-S. Seo and J.-M Woo, Miniaturisation of microstrip antenna, electronics letters, Jun. 10, 2004 vol. 40 No. 12.*

(Continued)

*Primary Examiner*—Douglas W Owens
*Assistant Examiner*—Dieu Hien T Duong
(74) *Attorney, Agent, or Firm*—Wolff & Samson PC

(57) ABSTRACT

A patch antenna having a plurality of structures, referred to herein as comb structures, is disclosed that results in an antenna having a reduced overall patch size and weight as well as a broader the angular response pattern of the antenna. In a first embodiment, comb structures are attached to one of the surface of the patch or the surface of the ground plane. In a second embodiment, the comb structures are attached to both the patch and the ground plane in a manner such that the structures interleave with each other. The structures may be pins or ribs that are electrically connected to the ground plane and/or the patch, or may be any other suitable configuration depending upon the polarization of the signal to be transmitted or received.

23 Claims, 2 Drawing Sheets

U.S. PATENT DOCUMENTS

| | | | | |
|---|---|---|---|---|
| 6,208,316 | B1 | 3/2001 | Cahill | |
| 6,218,978 | B1 | 4/2001 | Simpkin et al. | |
| 6,219,002 | B1 | 4/2001 | Lim | |
| 6,323,810 | B1 | 11/2001 | Poilasne et al. | |
| 6,567,048 | B2 | 5/2003 | McKinzie, III et al. | |
| 2006/0071859 | A1 * | 4/2006 | Condon et al. | 343/700 MS |

FOREIGN PATENT DOCUMENTS

| | | |
|---|---|---|
| JP | 10224142 (A) | 8/1998 |
| JP | 11251825 (A) | 9/1999 |
| WO | WO 01/93373 A1 | 12/2001 |
| WO | WO 02/31914 | 4/2002 |
| WO | WO 02/087012 | 10/2002 |
| WO | WO 03/012919 | 2/2003 |
| WO | WO 2005/117208 | 12/2005 |

OTHER PUBLICATIONS

European Patent Office Search Report for Corresponding European Patent Application No. 05027416.6.

Communication dated Dec. 20, 2007 from the European Patent Office in corresponding European Patent App. No. 05027416.6-220 (6 pages).

Japanese Examiner's Office Letter dated Nov. 18, 2008.

* cited by examiner

PATCH ANTENNA WITH COMB SUBSTRATE

This application claims the benefit of U.S. Provisional Application No. 60/644,948, filed Jan. 19, 2005, which is hereby incorporated herein by reference.

BACKGROUND OF THE INVENTION

The present invention relates to antennas and, more particularly, to patch antennas.

Patch antennas, which are typically characterized by a flat radiating element placed in close proximity to a ground plane, are used for many beneficial purposes, such as for individual elements in phased array antennas. Such patch antennas are gaining in popularity due, in part, to their relatively small size and relatively low production cost as compared to other types of antennas. The various uses of patch antennas are well known and will not be discussed further herein.

Patch antennas typically consist of a radiating patch separated from a ground plane by a dielectric substrate. Referring to FIG. 1, for example, a patch antenna in a typical prior implementation consists of a ground plane 101, radiating element (patch) 102, conducting probe 103, and standoffs 105, illustratively manufactured from a dielectric material, which are located around the patch's edges to separate the patch 102 from the ground plane 101. Conducting probe 103 is, for example, a conducting Radio Frequency (RF) transmission line such as, for example, an inner conductor of a well-known coaxial cable 104. The inner conductor 103 of conducting probe 103 is connected to patch 102 and is the conduit by which RF signals are passed to the patch 102. In operations of such a patch antenna, electromagnetic signals are input to the patch 102 via inner conductor 103 of coaxial cable 104 causing electrical currents to be induced on both the patch 102 and ground plane 101 and polarization currents to be induced in dielectric substrate 105 all of which in turn radiate electromagnetic wave in free space.

One skilled in the art will recognize that many different structures can be used in the manufacture of the patch antenna of FIG. 1 with various effects. For example, instead of using dielectric standoffs, the patch in some implementations is separated from the ground plane simply by air or a solid substrate of dielectric material. As is well-known, a dielectric material is a material that is a poor conductor of electricity, but one that can efficiently impact on electric field strength and on speed of electromagnetic wave traveling inside volume filled with said dielectric material. The use of such dielectric materials in many applications is extremely well-known. Dielectric materials are typically characterized by a dielectric constant, also called the dielectric permittivity $\in$ of the material. The impact of dielectric material on patch antenna performance depends not only on dielectric permittivity $\in$ but also on size and shape of substrate. Thus, the effective permittivity $\in_{eff}$ of the substrate is often used instead of the permittivity $\in$. This effective permittivity $\in_{eff}$ is generally a complicated function of both the permittivity $\in$ of the substrate material as well as the size and shape of the substrate. The first order approximation of the effective permittivity $\in_{eff}$ is directly proportional to $\in$. As is well-known, the length l of an antenna patch necessary to operate at a given frequency f is a function of the $\in_{eff}$ of the substrate. Specifically, the length l can be defined by the following equation:

$$l = \frac{c}{f(\varepsilon_{eff})^{1/2}} \quad \text{(Equation 1)}$$

where c is the well-known constant value for the speed of light. In order to achieve the smallest possible length of the antenna patch it is desirable to use an appropriate substrate having the highest $\in_{eff}$ value.

The operating characteristics of patch antennas, such as the patch antenna of FIG. 1, may be varied depending upon the physical dimensions and materials used in constructing the antenna. For example, as discussed above, for a given operating frequency, the size of the antenna must increase if a dielectric material with a lower dielectric constant is used. For this reason, air is sometimes used as a dielectric material since the $\in_{eff}$ of air is 1.0. Similarly, the length and/or width of the patch of an antenna may be increased to produce a lower operating frequency (also referred to herein as the resonant frequency). Also, the larger the antenna size, the narrower the antenna angular response pattern, which is the power flux produced by the antenna as a function of the angle relative to the center axis of the antenna. Additionally, all else equal, the operating frequency bandwidth of a patch antenna is influenced by substrate thickness. One skilled in the art will recognize how such dimensions will increase or decrease the resonant frequency and other operating characteristics of the antenna as a result of varying the dimensions of different components of the patch antenna. For example, patch antennas, such as the patch antenna of FIG. 1, are typically characterized by a relatively small operating frequency bandwidth due to the proximity of the patch to the ground plane in such antennas. Illustratively, the distance between the patch and the ground plane is approximately 1/20 of wavelength of signal to be transmitted or received by the antenna. As is well understood, increasing the thickness of a given substrate will desirably result in a corresponding increase of operating frequency bandwidth. However, such an increase in thickness will also undesirably increase the weight of the antenna.

SUMMARY OF THE INVENTION

The present inventors have recognized that it would be desirable in many implementations to reduce the size and weight of patch antennas and, at the same time, to increase the angular response pattern of a patch antenna. The present invention substantially achieves these objectives. In particular, the present invention is a patch antenna having a plurality of structures, referred to herein as comb structures, that are attached to the ground plane and/or the patch of the antenna. These comb structures are illustratively made of conductive materials (e.g., metals or dielectric painted by conductive paint). However, by using such a plurality of combs, the speed of a wave traveling across the structures is significantly reduced. Hence, such combs structures operate similarly to a dielectric and, therefore, could be characterized by effective dielectric constant $\in_{eff}$. The use of such comb structures serves to reduce the overall patch size (e.g., length and width) and to broaden the angular response pattern of the antenna.

In a first embodiment, comb structures are attached to one of the surface of the patch or the surface of the ground plane. In this embodiment, if the height of the structures and the shortest distance between the structures and the opposing surface is much smaller compared to the wavelength of the signal to be transmitted or received by the antenna (for example several hundredths the wavelength of the signal), then the ability of the structure to reduce the speed of traveling electromagnetic wave is approximately independent of the frequency of signal to be transmitted or received by the antenna. Hence such structure could be characterized by effective dielectric permittivity $\in_{eff}$ which is function of said height of the structures and the aforementioned shortest distance.

In a second embodiment, the comb structures are attached to both the patch and the ground plane in a manner such that the structures interleave with each other. In this embodiment, if the height of the structures and the distance between each structure on the same surface is much smaller compared to the wavelength of the signal to be transmitted or received by the antenna (once again, for example, on the order of several hundredths of the wavelength of the signal), then, also once again, the ability of the structure to reduce the speed of traveling electromagnetic wave is approximately independent of the frequency of signal to be transmitted or received by the antenna. Hence such structure could be characterized by effective dielectric permittivity $\in_{eff}$ which is function of said height of the structures and distance between each structure on the same surface In yet another embodiment, the structures are pins or ribs that are electrically connected to the ground plane and/or the patch depending upon the polarization of the signal to be transmitted or received.

DETAILED DESCRIPTION OF THE INVENTION

As discussed above, the angular response pattern of an antenna can be broadened by decreasing the length of a patch. To obtain this broadening for a given operating frequency of a patch antenna the $\in_{eff}$ of a substrate should be increased. This in turn results in narrowing the operating frequency band. To keep the operating frequency bandwidth at the desired value the thickness of the substrate should be increased to separate the patch from the ground plane by a greater distance. However, such an increase in thickness will have the detrimental effect of increasing the weight of the antenna. It would be desirable to maintain a constant $\in_{eff}$ of a substrate and length of a patch in an antenna while, at the same time, separating the ground plane from the patch.

Figure 1:
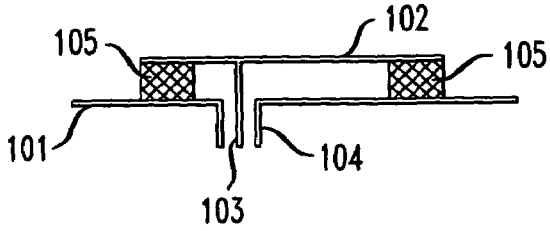
FIG. 1 PRIOR ART
FIG. 1 shows a prior art patch antenna.
Figure 2A:
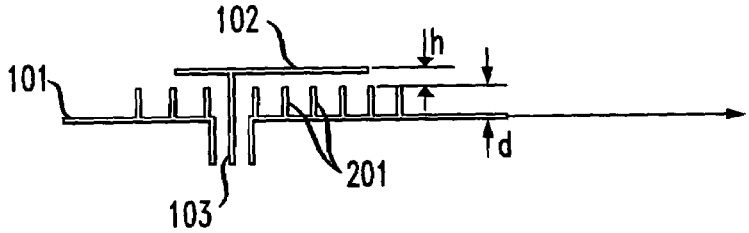
FIG. 2A shows a cross section view of a patch antenna in accordance with an embodiment of the present invention.
Figure 2B:
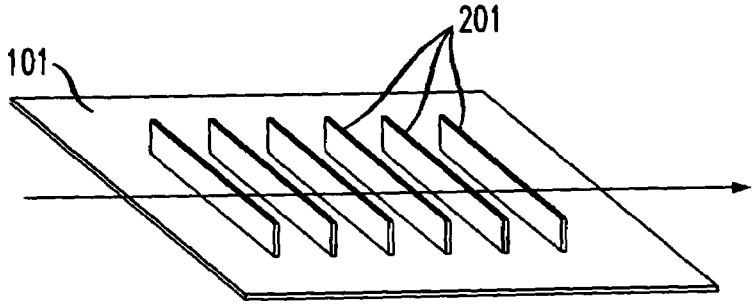
FIG. 2B shows a three-dimensional view of the patch antenna of FIG. 2A.

The present invention substantially achieves this objective. FIGS. 2A and 2B show one illustrative embodiment of a patch antenna in accordance with the principles of the present invention whereby the angular response of a patch antenna is increased while, at the same time, the weight of the antenna is not substantially increased and the $\in_{eff}$ and length of the patch are maintained constant. In particular, FIG. 2A shows a cross-section view of a patch antenna in accordance with the principles of the present invention that has a plurality of comb structures in the form of ribs attached to the ground plane of a patch antenna. Such a configuration where structures are only attached to one surface in the antenna is referred to herein as a single-side comb substrate. Illustratively, such a comb substrate is manufactured from metal strips, or ribs, that are electrically connected (e.g., via welding or any other suitable method to achieve an electrical connection with a surface of an antenna) to the ground plane 101. It will be readily apparent to one skilled in the art how to manufacture such a comb substrate. FIG. 2B shows an illustrative three-dimensional view of the antenna structure of FIG. 2A with patch 102 and probe 103 of FIG. 2A removed. Using the structure of FIGS. 2A and 2B, the present inventors have recognized that, for h and d being small relative to the wavelength of the signal (e.g., where h and d are less than one-half the wavelength of the of the signal) to be transmitted or received by the antenna, the effective permittivity $\in_{eff}$ of the substrate separating the ground plane from the patch could be estimated as:

$$\varepsilon_{eff} = 1 + \frac{d}{h} \qquad \text{(Equation 1)}$$

As can be seen from Equation 1, with the illustrative structure of FIGS. 2A and 2B, it is possible to proportionally increase both h and d, and thus increase the distance between the ground plane and the patch, while at the same time, keeping $\in_{eff}$ constant. For a given frequency, therefore, it is possible to obtain a wider antenna angular response pattern without a corresponding increase in antenna weight or size.

Figure 3:
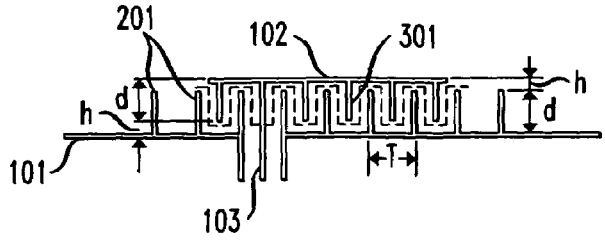
FIG. 3 shows a patch antenna whereby comb structures are used on both the patch and the ground plane of the antenna.

FIG. 3 shows another embodiment in accordance with the principles of the present invention whereby comb structures are used on both the patch and the ground plane to increase the $\in_{eff}$ of the substrate. Such a structure is referred to herein as a cross-comb structure. Here one or more set of ribs 301 are electrically connected to the patch 102. When both d and T are much smaller compared to wavelength of the signal (e.g., once again, where h and d are less than one-half the wavelength of the of the signal), then the effective permittivity $\in_{eff}$ of the substrate of the antenna can be described by the expression:

$$\varepsilon_{eff} = \left(1 + \frac{2d}{T}\right)^2 \qquad \text{(Equation 2)}$$

where d is the height of each rib and T is the spacing between the ribs attached to the same surface. Accordingly, one skilled in the art will recognize that, when d and T are much smaller than the intended signal wavelength, $\in_{eff}$ will not significantly change as the distance h in FIG. 3 changes. Therefore, once again, the patch 102 in FIG. 3 can be separated from the ground plane by a greater distance, thus increasing the operational bandwidth of the antenna while keeping $\in_{eff}$ constant and without increasing the weight of the antenna.

Figure 4:
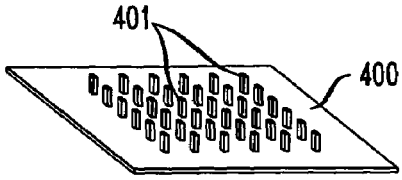
FIG. 4 shows a patch antenna having a single-side comb structures in the form of pins.

One skilled in the art will recognize that, due to the geometry of the ribs in the structures of FIGS. 2A, 2B and 3, such an antenna is primarily useful for patch antennas designed to transmit or receive linear polarized signals. However, some signals use other polarization, such as circular polarization. To accommodate signals having another polarization, other structures may be used in place of the foregoing rib structures. Specifically, in the example where a signal has a circular polarization, the present inventors have realized that comb structures may be made in the form of pins rather then ribs. FIG. 4 shows such an illustrative example of an antenna 400 having a single-side comb structure with pins 401. For ease of illustration, no patch is shown in FIG. 4. One skilled in the art will recognize in light of the foregoing discussion that such single-side structures made of pins could be used in the same manner as with the previously described rib structures, such as placing pins on only one surface of the antenna (as in FIGS. 2A and 2B) or, alternatively, placing pins on two opposing surfaces of the antenna (as in FIG. 3). For pins that are manufactured on a single surface, similar to the ribs of FIGS. 2A and 2B, the $\in_{eff}$ of a substrate having pins 401 disposed thereon can be determined according to Equation 1. Thus, similar to the antenna of FIG. 2A, by proportionately increasing the separation distance between the patch and the ground plane, the $\in_{eff}$ of the substrate of the antenna 400 will not change. Similarly, by placing pins on both the patch and the ground plane, similar to the cross-comb structure ribs of the antenna of FIG. 3, the $\in_{eff}$ of the substrate can be determined according to Equation 2. One skilled in the art will be able to devise, in light of the foregoing, other single-side or cross-comb structures to accommodate other types of signal polarization.

Figure 5:
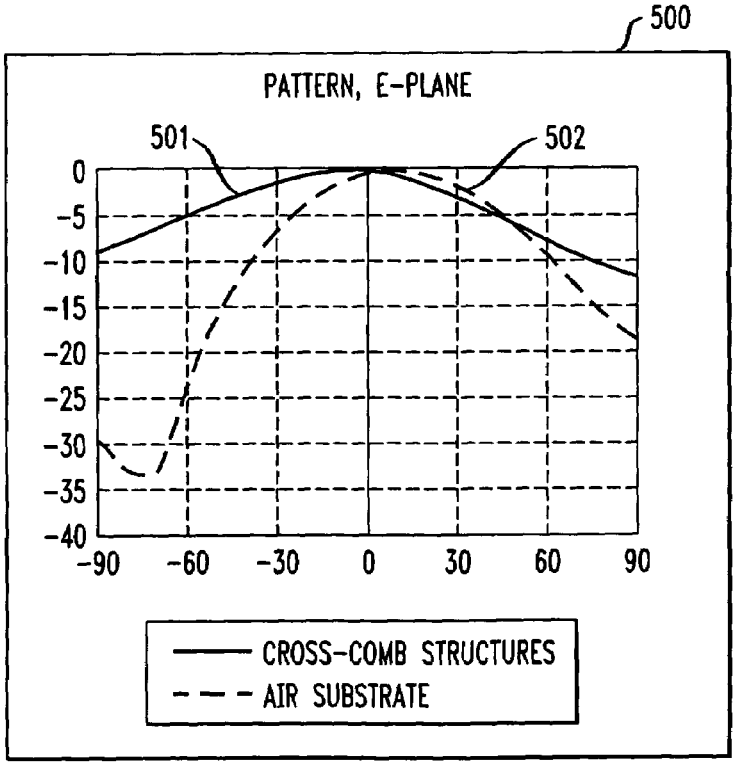
FIG. 5 shows an illustrative antenna angular response pattern of a patch antenna having comb structures.

FIG. 5 shows an illustrative antenna angular response pattern of the patch antenna with an illustrative cross-comb substrate, such as that shown in FIG. 3, as compared with an air substrate. Referring to that figure, line 501 represents the response pattern of an antenna having an illustrative cross-comb substrate as discussed above in association with FIG. 3. Line 502 on the other hand shows an antenna having an air substrate. As is evident from the graph of FIG. 5, use of such a comb substrate leads to pattern width increase. Specifically, at an angle of −90 degrees with respect to the center axis of the antenna, the response of a cross-comb substrate is at −10 dB while the air substrate antenna is at −30 dB. As one skilled in the art will recognize from the graph of FIG. 5, the response of the antenna with a cross-comb substrate is much more desirable for many uses compared to the antenna using an air substrate.

In addition to increasing the bandwidth of a patch antenna while keeping the weight of the antenna low, adding comb structures such as those discussed above has other advantages. For example, such comb-structured substrates such as those described herein, are advantageous in that they can be used at in a relatively harsh environment such as that which would be experienced in a chemically aggressive or corrosive media or in other difficult environments such as would be experienced by a satellite in space orbit. In such an environment it is often impossible or impractical to use conventional dielectric substrates due to, for example, the thermal properties of some dielectric materials.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

What we claim is:

1. A patch antenna comprising:

a conducting patch;

a ground plane separated from said conducting patch by a dielectric; and a plurality of spaced-apart conducting pins, projecting from, and having a height from, at least one of said conducting patch or said ground plane;

wherein:

said plurality of spaced-apart conducting pins is located in between said conducting patch and said ground plane;

the height of each pin in said plurality of spaced-apart conducting pins is less than the separation between said conducting patch and said ground plane;

a first portion of said plurality of spaced-apart conducting pins is disposed on said conducting patch;

a second portion of said plurality of spaced-apart conducting pins is disposed on said ground plane;

the dielectric between said conducting patch and said ground plane is air; and said patch antenna is configured for circularly-polarized radiation.

2. The patch antenna of claim 1, wherein the height of each pin in said plurality of spaced-apart conducting pins is less than the wavelength of a radio frequency signal to be transmitted or received by said antenna, and wherein the spacing between each pin in said plurality of spaced-apart conducting pins is less than said wavelength.

3. The patch antenna of claim 2 wherein the height of each pin in said plurality of spaced-apart conducting pins is less than ¼ said wavelength.

4. The patch antenna of claim 3 wherein said height is approximately 1/20 said wavelength.

5. The patch antenna of claim 2 wherein said spacing is shorter than one-half of said wavelength.

6. The patch antenna of claim 2 wherein the effective permittivity of the dielectric is a function of the height of said plurality of spaced-apart conducting pins and the spacing between each pin in said plurality of spaced-apart conducting pins.

7. The patch antenna of claim 6 wherein the effective permittivity $\in_{eff}$ of the dielectric is defined according to the expression $$\varepsilon_{eff} = \left(1 + \frac{2d}{T}\right)^2$$

where d is the height of each pin in said plurality of spaced-apart conducting pins and T is the spacing between each pin in said plurality of spaced-apart conducting pins.

8. A patch antenna comprising:

a conducting patch;

a ground plane separated from said conducting patch by a dielectric; and a plurality of spaced-apart conducting pins, projecting from, and having a height from, said ground plane;

wherein:

said plurality of spaced-apart conducting pins is located between said conducting patch and said ground plane;

the height of each pin in said plurality of spaced-apart conducting pins is less than the separation between said conducting patch and said ground plane;

the dielectric between said conducting patch and said plurality of spaced-apart conducting pins is air; and said patch antenna is configured for circularly-polarized radiation.

9. The patch antenna of claim 8, wherein the height of each pin in said plurality of spaced-apart conducting pins is less than the wavelength of a radio frequency signal to be transmitted or received by said antenna, and wherein the spacing between each pin in said plurality of spaced-apart conducting pins is less than said wavelength.

10. The patch antenna of claim 9 wherein the height of each pin in said plurality of spaced-apart conducting pins is less than ½ said wavelength.

11. The patch antenna of claim 9 wherein the height of each pin in said plurality of spaced-apart conducting pins is less than ¼ said wavelength.

12. The patch antenna of claim 11 wherein said height is approximately 1/20 said wavelength.

13. The patch antenna of claim 9 wherein said spacing is shorter than one-half of said wavelength.

14. The patch antenna of claim 9 wherein the effective permittivity of said dielectric is a function of said height and a distance between each pin in said plurality of spaced-apart conducting pins and an opposing surface.

15. The patch antenna of claim 14 wherein the effective permittivity $\in_{eff}$ of the dielectric is defined according to the expression $$\varepsilon_{eff} = 1 + \frac{d}{h}$$

where d is the height of each pin in said plurality of spaced-apart conducting pins and h is the distance between each pin in said plurality of spaced-apart conducting pins and an opposing surface.

16. A patch antenna comprising:

a conducting patch;

a ground plane separated from said conducting patch by a dielectric; and a plurality of spaced-apart conducting pins, projecting from, and having a height from, said conducting patch;

wherein:

said plurality of spaced-apart conducting pins is located between said conducting patch and said ground plane;

the height of each pin in said plurality of spaced-apart conducting pins is less than the separation between said conducting patch and said ground plane;

the dielectric between said conducting patch and said ground plane is air; and said patch antenna is configured for circularly-polarized radiation.

17. The patch antenna of claim 16, wherein the height of each pin in said plurality of spaced-apart conducting pins is less than the wavelength of a radio frequency signal to be transmitted or received by said antenna, and wherein the spacing between each pin in said plurality of spaced-apart conducting pins is less than said wavelength.

18. The patch antenna of claim 17 wherein the height of each pin in said plurality of spaced-apart conducting pins is less than one-half said wavelength.

19. The patch antenna of claim 17 wherein the height of each pin in said plurality of spaced-apart conducting pins is less than ¼ said wavelength.

20. The patch antenna of claim 19 wherein said height is approximately 1/20 said wavelength.

21. The patch antenna of claim 17 wherein said spacing is shorter than one-half of said wavelength.

22. The patch antenna of claim 17 wherein the effective permittivity of the dielectric is a function of said height and a distance between each pin in said plurality of spaced-apart conducting pins and an opposing surface.

23. The patch antenna of claim 22 wherein the effective permittivity $\in_{eff}$ of said dielectric is defined according to the expression $$\varepsilon_{eff} = 1 + \frac{d}{h}$$

where d is the height of each pin in said plurality of spaced-apart conducting pins and h is the distance between each pin in said plurality of spaced-apart conducting pins and an opposing surface.

* * * * *